US006873262B2

(12) United States Patent
Midlang

(10) Patent No.: US 6,873,262 B2
(45) Date of Patent: Mar. 29, 2005

(54) MAINTAINING ILLUMINATION INTENSITY OF A LIGHT EMITTING DIODE IN A DOMESTIC APPLIANCE

(75) Inventor: Brian Midlang, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 71 days.

(21) Appl. No.: 10/446,687

(22) Filed: May 29, 2003

(65) Prior Publication Data

US 2004/0239519 A1 Dec. 2, 2004

(51) Int. Cl.[7] ..... G08B 17/00

(52) U.S. Cl. ..... 340/585; 340/815.45; 345/102; 315/291; 315/200 R

(58) Field of Search ..... 340/585, 815.45; 315/200 R, 202, 205, 206, 291; 362/92; 345/82, 102

(56) References Cited

U.S. PATENT DOCUMENTS 4,090,189 A * 5/1978 Fisler ..... 315/169.1
5,457,450 A 10/1995 Deese et al.
5,663,719 A 9/1997 Deese et al.
5,783,909 A 7/1998 Hochstein
6,153,985 A * 11/2000 Grossman ..... 315/291
6,236,331 B1 5/2001 Dussureault
6,529,182 B1 * 3/2003 Burton ..... 345/102
6,717,526 B2 * 4/2004 Martineau et al. ..... 340/815.45
6,750,842 B2 * 6/2004 Yu ..... 345/102

* cited by examiner

*Primary Examiner*—John Tweel
(74) *Attorney, Agent, or Firm*—Diederiks & Whitelaw, PLC

(57) ABSTRACT

The illumination intensity of light emitting diode in an appliance display is maintained over time by automatically increasing an amount of electric current supplied to the light emitting diode, preferably incrementally, over the life of the light emitting diode. The automatic increase in current compensates for the gradual decay of the light emitting diodes over time, thereby allowing the light emitting diodes to maintain a constant illumination for the lifetime of the appliance.

14 Claims, 2 Drawing Sheets

MAINTAINING ILLUMINATION INTENSITY OF A LIGHT EMITTING DIODE IN A DOMESTIC APPLIANCE

BACKGROUND OF THE INVENTION

1. Field of the Invention

The present invention pertains to the art of appliances and, more particularly, to a method for maintaining illumination of an display LED of an appliance over an extended period of time.

2. Discussion of the Prior Art

In recent years, certain household appliances have been manufactured with display units for allowing users to select different criteria or read messages displayed by the appliances. Such a display unit is often defined by a liquid crystal display with an array of light emitting diode (LED) backlights.

A drawback of LED backlights is that the output intensity of the backlights decreases steadily with time. Some factors that affect the rate at which an LED's intensity diminishes include the amount of electric current used to drive the LED, the temperature of the environment in which the LED is operated, and the humidity of the environment in which the LED is operated. When LEDs are used in an appliance, the minimum amount of electric current required to drive the LEDs at an acceptable brightness is approximately 10 mA. When the LED is operated in an environment of about 25° C., the relative illumination level is reduced by an average of 50% after 50,000 hours. Since the typical lifetime of a household appliance far exceeds 50,000 hours, supplying current to the LEDs at a constant rate of 10 mA undesirably results in a time varying intensity.

Several attempts and suggestions have been made to solve the problems associated with the deterioration of LEDs over time. For example, it is possible to double the lifetime of LEDs by doubling the number of LEDs and cutting the current supplied to each LED by 50%. However, there are significant costs associated with doubling the number of LEDs used in appliance control panels, which make this option undesirable. Another method of maintaining a consistent output of LEDs over time is to employ a sensor to detect when the LED output begins to diminish and to increase the voltage supplied to the LED based on the output of the sensor. This option may also be cost prohibitive due to the addition and maintenance of the sensor. Therefore, there is a need for a method and arrangement for maintaining the light intensity of LEDs provided in an appliance display without significantly increasing the costs of manufacturing the appliance.

SUMMARY OF THE INVENTION

The present invention is directed to maintaining the illumination intensity of a light emitting diode (LED) in an appliance display over an extended period of time. The intensity is maintained by automatically increasing an amount of electric current supplied to the light emitting diode incrementally over the life of the light emitting diode. More particularly, a power supply is connected to an array of light emitting diodes and a controller is employed for automatically increasing the electric current transferred to the array of light emitting diodes. The automatic increase in current compensates for the gradual decay of the light emitting diodes over time, thereby allowing the light emitting diodes to maintain a substantially constant illumination for the lifetime of the appliance.

Additional objects, features and advantages of the present invention will become more readily apparent from the following detailed description of a preferred embodiment when taken in conjunction with the drawings, wherein like reference numerals refer to corresponding parts in the several views.

DETAILED DESCRIPTION OF THE PREFERRED EMBODIMENT

Figure 1:
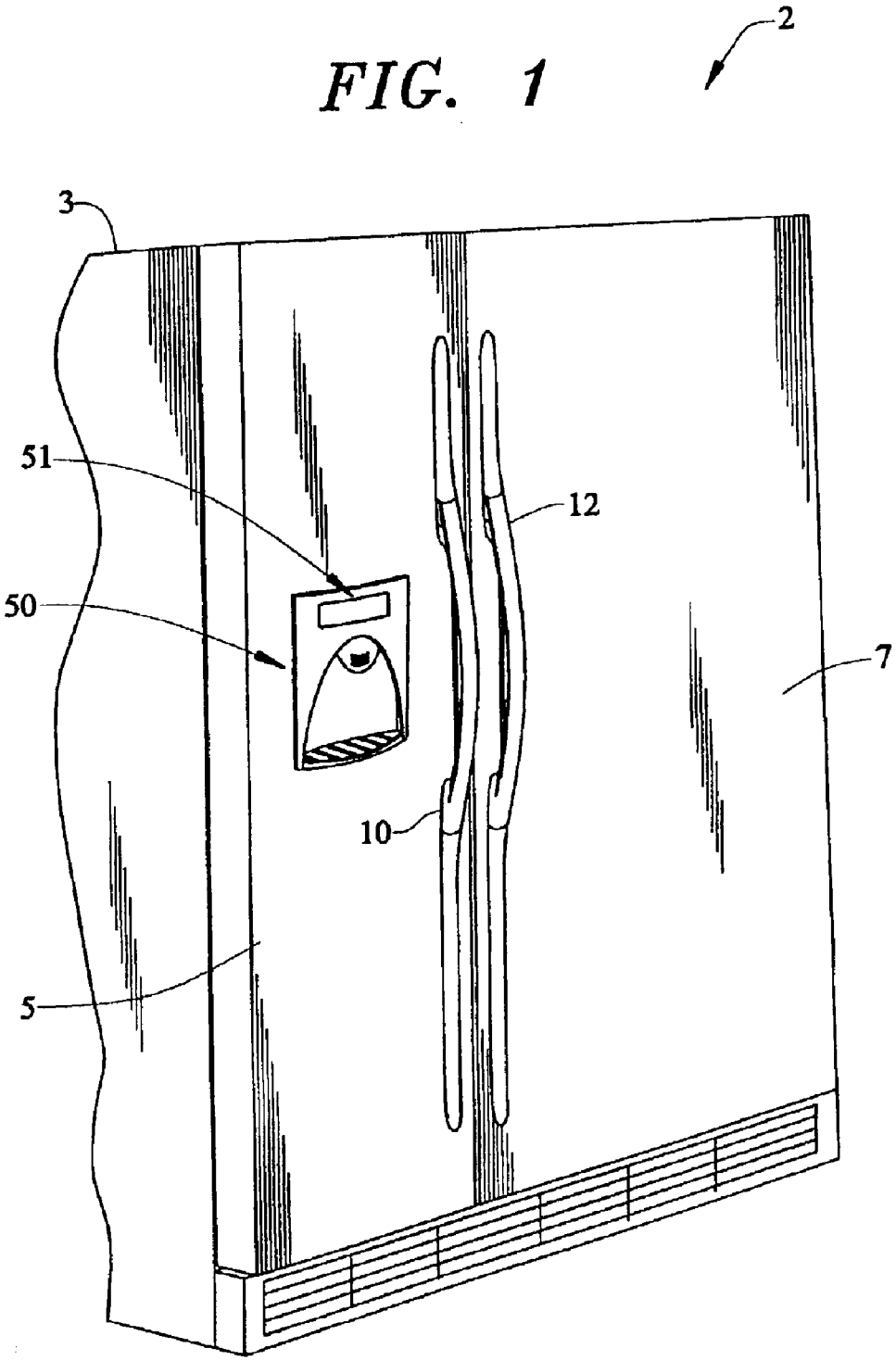
FIG. 1 is a perspective view of a portion of a side-by-side refrigerator incorporating the LED illumination intensity control arrangement of the present invention.

With initial reference to FIG. 1, a side-by-side refrigerator is generally indicated at 2. In a manner widely known in the art, side-by-side refrigerator 2 is formed from a cabinet shell 3 to which is pivotably attached a freezer compartment side door 5 and a fresh food compartment side door 7, each of which includes a respective handle 10, 12.

As also shown in FIG. 1, freezer compartment side door 5 is provided with a dispensing assembly 50 which can be used to dispense either water or ice. Indicated at 51 is a display, preferably a liquid crystal display (LCD), incorporated in dispensing assembly 50. Although not shown, dispensing assembly 50 also preferably has associated therewith fountain control buttons used for selecting between crushed and cubed ice, dispensing water, or activating a light button. At this point, it should be recognized that separate fountain control buttons can be employed or display 51 can actually constitute a touch screen display which incorporates the fountain controls. Regardless, display 51 is employed to provide various messages to a user. Display 51 is backlit by light emitting diodes (LEDs), such as schematically indicated at 60 in FIG. 2.

In general, the above described structure of a side-by-side refrigerator 2 is known in the art, does not form part of the present invention, and is provided for the sake of completeness. The present invention is particularly directed to a method and apparatus for maintaining the illumination intensity of light emitting diodes 60 in appliance display 51 over an extended period of time. Again, the array of light emitting diodes 60, hereinafter referred to as LEDs, is preferably used to backlight display 51. In accordance with the most preferred embodiment, display 51 includes seven white LEDs 60 driven at approximately 10 mA in order to achieve the minimum acceptable brightness level for display 51. However, the intensities of LEDs 60 will decay over time such that their output intensities decrease. For example, when LEDs 60 are supplied with a constant current of approximately 10 mA at 25° C., the relative luminous intensity will decrease, on average, by 50% in 50,000 hours. As the average life of a household appliance is much greater than 50,000 hours, it is desired in accordance with the present invention to counteract the intensity decay of LEDs 60. Since the,luminous intensity of LEDs 60 increases linearly as the drive current is increased, it is possible to compensate for the decay of LEDs 60 by gradually increasing the drive current.

Therefore, in accordance with the invention, the illumination intensity is maintained at a substantially constant level by automatically increasing the amount of electric current supplied to LEDs 60. By "automatically increasing" it is meant that the current is increased independent of any outside influence. In other words, the increase in current is not a response to a change detected by a sensor such as a temperature or light intensity sensor. Instead, the current is automatically increased incrementally or periodically.

Figure 2:
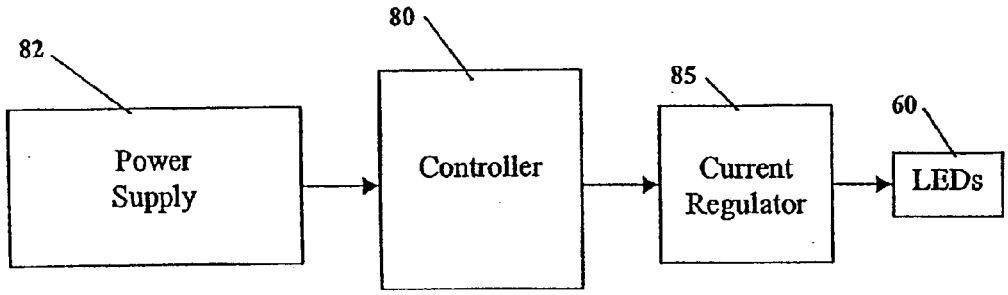
FIG. 2 is a schematic view of the illumination intensity control arrangement employed in the refrigerator of FIG. 1.

As shown in FIG. 2, a controller 80 incorporated into refrigerator 2 functions to distribute power to power consuming devices of refrigerator 2 from a power supply 82. In particular, controller 80 distributes a drive current from power supply 82 to the array of LEDs 60 through a current regulator 85. In accordance with the invention, controller 80 automatically signals current regulator 85 to increase the amount of drive current supplied to LEDs 60 over time. For example, with LEDs 60, having a luminous intensity which decreases exponentially, being initially driven at 9 mA at 25° C., after 10,000 hours, the luminous intensity would be in the order to 0.87, i.e. decreased by 13%, when still driven at 9 mA at 25° C. However, in accordance with the invention, controller 80 will automatically increase the drive current supplied to LEDs 60 by 1 mA, thereby maintaining the desired intensity. For instance, by increasing the drive current by 1 mA, the luminous intensity is increased by approximately 11%. Therefore, the luminous intensity is raised from 0.87 to 0.98, i.e., nearly 100%.

Therefore, in accordance with the invention, the luminous intensity will be maintained at a substantially constant level for a period of time much greater than that of an LED 60 driven at a constant current. In accordance with a preferred embodiment, controller 80 is preprogrammed to increase the drive current sent to LEDs 60 by approximately 1 mA per 10,000 hours. Of course, the increase may be varied in other ways, such as by increasing the current by a fraction of 1 mA at set intervals over the 10,000 hours. By automatically increasing the drive current, LEDs 60 will need to be replaced much less frequently. Obviously, costs associated with any output intensity sensors are eliminated. Since the decay of LEDs 60 can be readily predicted in household appliances, the present invention represents a cost efficient and reliable solution to automatically increase the drive current supplied to LEDs 60. Therefore, with this arrangement, the only limitation would be the maximum drive current that LEDs 60 can handle.

Although described with reference to a preferred embodiment of the invention, it should be readily understood that various changes and/or modifications can be made to the invention without departing from the spirit thereof. For instance, although the invention is disclosed in connection with a display on a refrigerator, the invention could be equally employed in cooking appliances, dishwashers, clothes washing machines, drying machines, and the like. In general, the invention is only intended to be limited by the scope of the following claims.

I claim:

1. In a domestic appliance, a method of maintaining an illumination intensity of a light emitting diode, incorporated in a display, over an extended period of time comprising automatically increasing an amount of electric current supplied to the light emitting diode over an operating life of the light emitting diode.

2. The method of claim 1, wherein the domestic appliance is a refrigerator.

3. The method of claim 1, wherein the display includes an operator input selector.

4. The method of claim 3, wherein the operator input selector allows a user to select from water, cubed ice, or crushed ice.

5. The method of claim 1, wherein the electric current supplied to the light emitting diode is incrementally increased.

6. The method of claim 5, wherein the drive current is increased at a rate in the order of 1 mA per 10,000 hours.

7. The method of claim 5, wherein the electric current supplied to the light emitting diode is periodically increased.

8. A domestic appliance comprising:

a cabinet;

a display employing light emitting diodes;

a power supply connected to said light emitting diodes;

controller means for automatically increasing drive current delivering to said light emitting diodes over time such that the light emitting diodes emit a substantially constant light intensity.

9. The domestic appliance of claim 8, wherein the cabinet constitutes a refrigerator cabinet.

10. The domestic appliance of claim 8, wherein the display includes an operator input selector.

11. The domestic appliance of claim 10, wherein the operator input selector allows a user to select from water, cubed ice, or crushed ice.

12. The method of claim 8, wherein the controller means incrementally increases the drive current.

13. The domestic appliance of claim 12, wherein the controller means increases the drive current at a rate in the order of 1 mA per 10,000 hours.

14. The domestic appliance of claim 12, wherein the controller means periodically increases the drive current.

* * * * *